United States Patent [19]

Wilcox

[11] Patent Number: 4,459,787

[45] Date of Patent: Jul. 17, 1984

[54] EARTH ANCHOR

[76] Inventor: Stanley W. Wilcox, 4187 South St. Louis Ave., Tulsa, Okla. 74105

[21] Appl. No.: 422,707

[22] Filed: Sep. 24, 1982

[51] Int. Cl.[3] ..... E02D 5/74

[52] U.S. Cl. ..... 52/155; 248/545; 135/20 R

[58] Field of Search ..... 52/155; 40/607, 606; 248/544, 545, 532; 173/91; 135/20 R

[56] References Cited

U.S. PATENT DOCUMENTS

| | | | |
|---|---|---|---|
| 2,475,041 | 7/1949 | Mattson | 248/156 |
| 2,759,486 | 8/1956 | Pesaturo | 248/545 |
| 2,867,041 | 1/1959 | McMillan | 52/155 |
| 3,182,937 | 5/1965 | Manning | 248/545 |
| 3,286,962 | 11/1966 | Warth | 248/545 |
| 3,318,560 | 5/1967 | Garrette | 248/532 |

*Primary Examiner*—John E. Murtagh
*Assistant Examiner*—Kathryn L. Ford
*Attorney, Agent, or Firm*—Head, Johnson & Stevenson

[57] ABSTRACT

An earth anchor having an elongated pointed shaft, a stop member affixed to the shaft intermediate the ends, a weighted impactor having an internal opening and being slidably received on the shaft, the impactor being engageable with the stop member by reciprocal motion to drive the shaft into the earth, the shaft having a series of spaced openings in the upper portion thereof and an elongated handle member receivable in selected openings whereby the shaft may be rotated as it is driven into the earth, the handle member being useable for impact by upward movement of the impactor to extract the anchor from the earth, and to serve as a lock to arrest the movement of the impactor when being transported.

5 Claims, 5 Drawing Figures

EARTH ANCHOR

BRIEF SUMMARY OF THE INVENTION

It is frequently necessary to drive members into the earth such as to support umbrellas, to serve as tent stakes, to form an anchor for a winch line, and so forth. One known means of driving an anchor or a stake into the ground is by reciprocally sliding a weight on the anchor to engage a stop below the weight. The repeated reciprocal motion of the weight can quickly and expeditiously drive the anchor into the earth. The present invention is directed towards improvements in this basic concept.

One important improvement of the invention is the provision of a plurality of spaced apart radial openings through the shaft in the upper portion thereof. An elongated handle member is employed in conjunction with the shaft. A slidable impactor is received on the shaft above the stop member. By extending the elongated handle in an opening in the upper end of the shaft, the shaft can be rotated as the reciprocal impactor is impinged on the stop member to drive the anchor more efficiently and effectively into the earth. This is particularly true when the lower end of the anchor is provided with a chisel point.

One problem with anchors of the type having an elonngated cylindrical shaft with a stop member and a reciprocal impactor is that of keeping the impactor on the shaft in a preselected position when the device is being hauled or shipped. If the impactor is left loose on the shaft it can slide around and cause potential damage to a vehicle in which the anchor is carried or to packaging in which the anchor is housed during shipment. To obviate the problem of a loose impactor on an anchor shaft, the invention provides a unique means of employing the elongated handle to retain it in position. For this purpose, the impactor has, on the exterior surface and in a plane of its longitudinal axis, a groove. The groove is tapered, that is, it is of a deeper depth at one end of the impactor and a shallower depth at the other end of the impactor. The handle is provided with integral 90° portions. One portion may be extended into an opening in the upper end of the shaft and the impactor positioned such that the groove deep end is in engagement with the other end of the handle which extends generally parallel the shaft. By sliding the impactor towards the portion of the handle which is received in the shaft axial opening, the inclined groove wedges and handle in the radial opening in the shaft and at the same time applies pressure against the impactor so that it becomes locked in position.

The employment of a handle which is removably positioned in an opening in the upper end of the shaft also provides an upper stop for use in retracting the anchor from the earth.

The shaft may be a unitary device but preferably is of two components, that is, an upper portion and a lower portion with the stop member being at the point of engagement of the upper and lower portion. The upper portion is preferably tubular. In this manner, umbrellas or other devices having small diameter handle portions may be received in the tubular portion.

Such umbrellas of a size convenient for transporting in a vehicle along with a small folding table and two chairs provides an attractive comfortable combination at parks, playgrounds, beaches, or around swimming pools. This combination or singly offers and excellent opportunity as a rental service wherever crowds gather for social, recreational, or amusement events.

Other types of umbrellas, having a handle with a larger internal diameter recess can be received over the top of the tubular upper portion.

If the impactor is locked into an upper hole of the tube, its internal bore provides a third dimension for utilization. A fishing rod handle can be inserted into the extended impactor to park it when casting offshore or along the bank of a stream or lake.

The device is essentially a monopod, useful wherever devices require support in an upright attitude, such as for the erection of gaming fixtures, signs, flags, markers, etc.

It can provide a firm tie-down for beaching a boat or securing and tending animals.

It can also serve as a splitter, chiseler, pry or even a lever and can be used to aerate the top soil.

Thus the anchor of this invention provides a unique, highly useful device for use by campers, picnickers, beach users, and for many other purposes.

DETAILED DESCRIPTION

Figure 1:
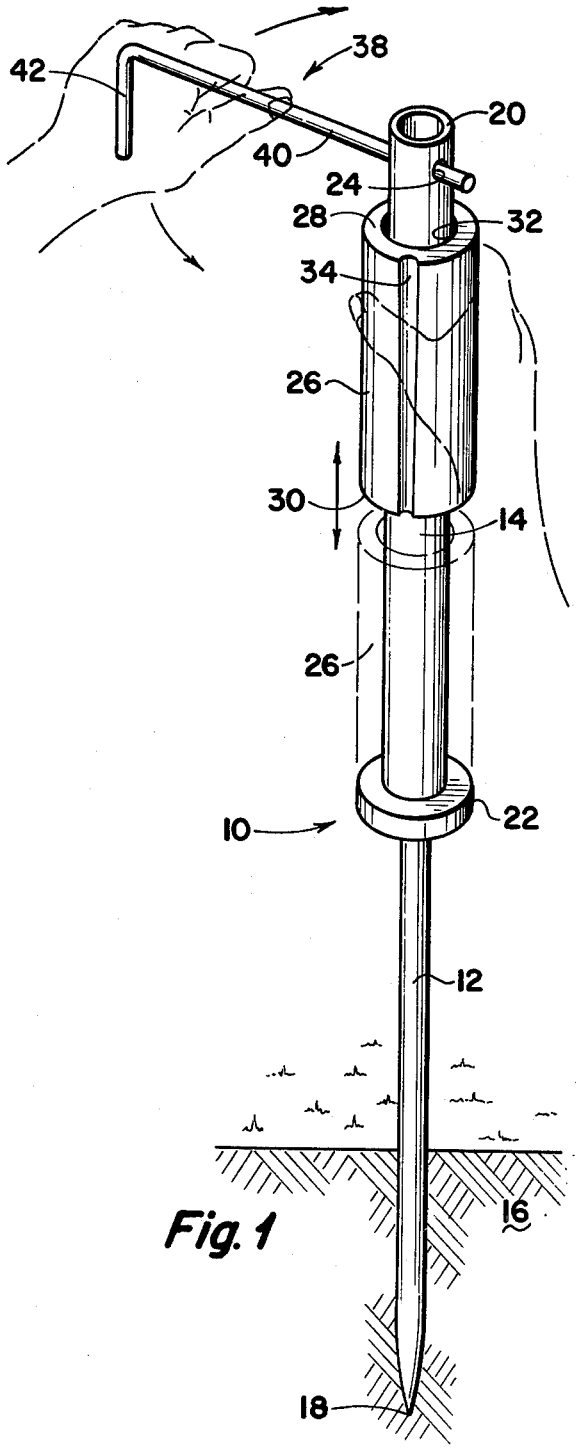
FIG. 1 is an elevational view of an earth anchor employing the principles of this invention and showing in dotted outline the hands of the user as employed in practice of the invention.

Referring to the drawings, and first to FIG. 1, an exemplified embodiment of the invention is illustrated, it being understood that the actual device which encompasses the principles of this invention may have an appearance different from that illustrated for purposes of exemplification.

The earth anchor of this invention is generally indicated by the numeral 10. The basic element of the earth anchor is a shaft having a lower portion 12 and an upper portion 14. It can be seen that in its simplest embodiment the shafts 12 and 14 may be a unitary element, but there are advantages in having a shaft lower portion 12 which is solid and a shaft upper portion 14 which is tubular. The shaft lower portion 12 is that portion which is intended to be driven into the earth 16. The lower end 18 of the shaft lower portion 12 is pointed. The pointed end 18 can be a circumferential point, that is, where it is pointed in all planes of the shaft longitudinal axis, but is preferably of a chisel point, that is, where it is pointed in one plane of the shaft longitudinal axis and is of the full width of the shaft in the perpendicular plane. The reason for the advantage of the chisel point end will be set forth subsequently. The shaft upper portion has an upper end 20. Intermediate the shaft lower end 18 and upper end 20 is an enlarged diameter stop member 22. When the shaft is formed of an upper portion and lower portion as illustrated, the stop member 22 is preferably between the two portions.

Figure 2:
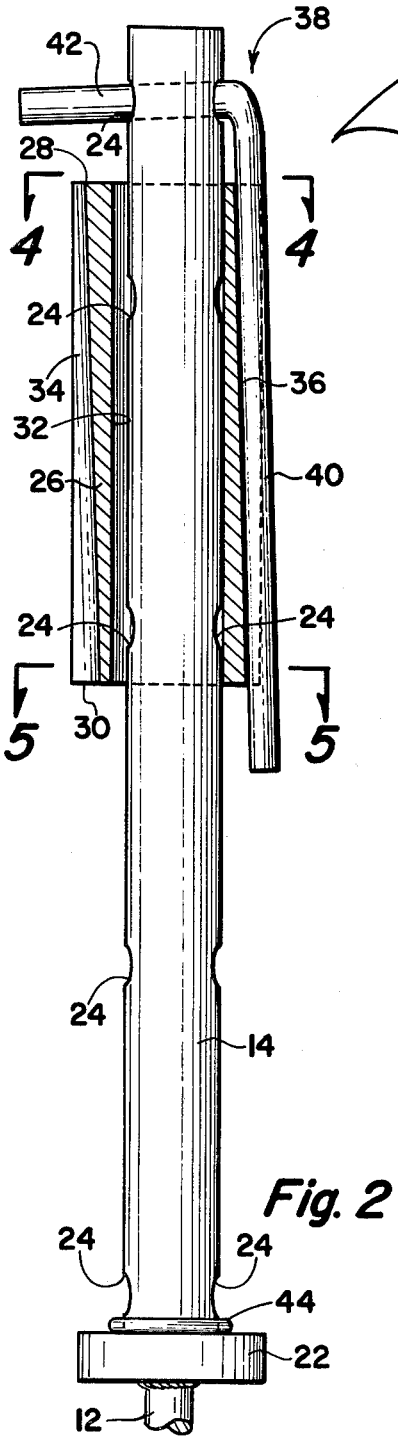
FIG. 2 is an enlarged elevational view of the upper portion of the anchor with the impactor shown in cross-section.

Formed in the shaft upper portion 14, as best seen in FIG. 2, are a plurality of spaced-apart axial openings 24, the axis of the openings 24 being perpendicular the longitudinal axis of the shaft upper portion 14.

Slidably receivable on the shaft upper portion is an impactor 26 having an upper end 28 and a lower end 30. The impactor has an axial opening 32 therethrough of an internal diameter greater than the external diameter of the shaft upper portion 14 and less than the external diameter of the stop member 22. The impactor is thus reciprocal on the shaft upper portion.

The external configuration of the impactor is not critical. However, it is preferably, as illustrated, generally cylindrical and is provided with external grooves 34 and 36. Each of the grooves 34 and 36 is in a plane of the longitudinal axis of the impactor and in the plane of the axis of the opening 32. Each groove is tapered, that is, groove 34 is shallow adjacent the upper end 28 and deeper adjacent the lower end 30, as clearly shown in FIG. 2. The groove 36 is oriented oppositely, that is, it is shallow adjacent the impactor bottom end 30 and deeper adjacent the upper end 28. The grooves are preferably 180° apart on the exterior surface of the impactor.

The third independent element making up the earth anchor is an elongated handle generally indicated by the numeral 38. The handle member is formed of an elongated portion 40 and, at one end, a shorter length angular portion 42, the portions 40 and 42 being at right angles. The diameter of the handle 38 is less than the diameter of openings 24 so that it can be positioned in the spaced-apart openings through the shaft upper portion.

Received on shaft upper portion 14 and in engagement with the stop member 22 is an O-ring 44.

OPERATION

The elements of the invention having been described, the manner in which the invention is utilized will now be set out so that the advantages and benefits of the invention can be better understood.

FIG. 1 shows the anchor being driven into the earth 16. The lower point 18 is below the surface. The drawing shows the impactor 26 being reciprocated up and down to strike the stop member 22. Each downward blow of the impactor against the stop member imparts significant impact to cause the shaft lower portion 24 to penetrate the earth. When the earth is free of rocks, the lower shaft portion 12 can normally be driven into the earth very easily in a very short time. However, if the earth 16 includes rocks, or is very hard and dry, more difficulty may be experienced in driving the anchor. For this reason, as illustrated in FIG. 1, the handle 38 may be positioned with the long portion 40 in an opening 24. As the user employs one hand to reciprocate the impactor 26 against top member 22, he can use the other hand, as illustrated, to rotate the anchor shaft about its axis. When the lower end 28 is a chisel point (a preferred arrangement as above discussed), the rotation of the handle as impact is being applied will more effectively break up rocks or extremely hard, dry packed soil so that the anchor can be used in areas where it could not otherwise be easily employed.

Figure 3:
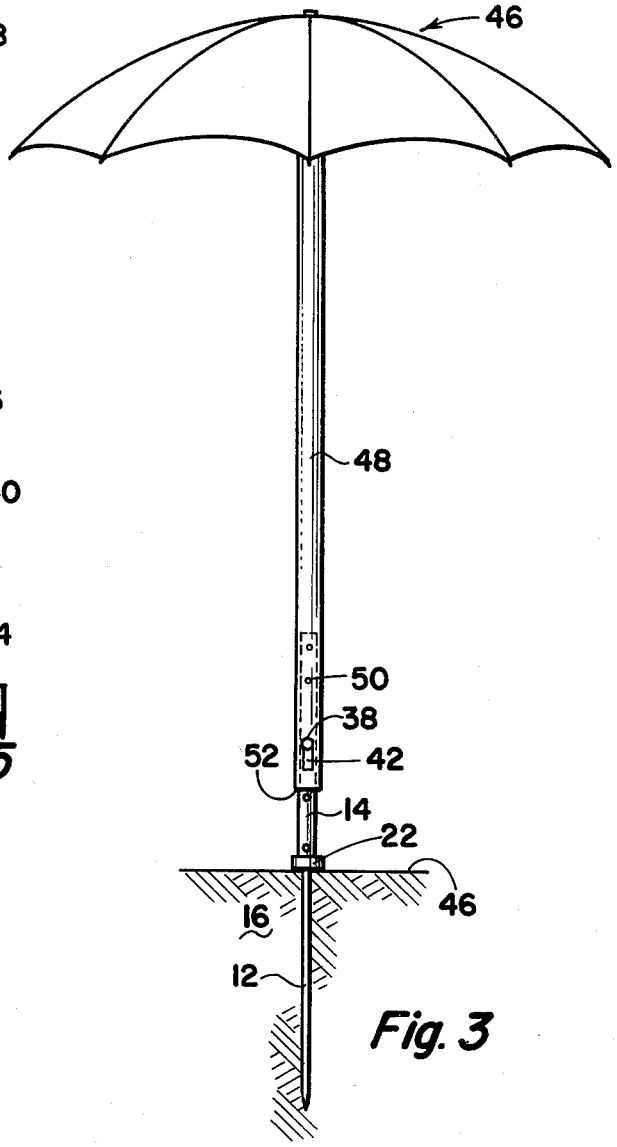
FIG. 3 is an elevational view of the anchor mounted in position such as to support a beach umbrella.

When the earth anchor has been driven into the ground as shown in FIG. 3 so that stop member 22 is near or in engagement with the surface 46 of the earth, the anchor may be employed for a variety of purposes. One illustrated use is to support an umbrella 46 having a tubular handle 48 which is typical of beach type umbrellas or umbrellas frequently employed with picnic tables and the like. The internal diameter of the tubular handle 38 is sufficiently large to extend over the shaft upper portion 14. The umbrella handle 48 may have spaced apart openings in it and in such case, the elongated portion 40 of the handle 38 may be extended through an opening 50 and an aligned opening 24 in the shaft upper portion so the umbrella handle is held in secure position on the anchor. If the umbrella handle 48 does not have openings 50 in it, it can rest with the lower end 52 in engagement with the handle 38 extending through an opening 24 in the shaft. In this way the elevation of the umbrella can be selected.

Other umbrellas may have handles with small diameters which can extend internally of the tubular shaft upper portion 14. In such cases the use of handle 38 extending through one of the openings 24 can be employed to adjust the height of the umbrella.

When the impactor 26 is driven downwardly with force against the stop member 22, noise develops. To improve quietness of operation, an O-ring 44 may be placed on the shaft upper portion 14 in engagement with the top surface of the stop member 22. The O-ring is sufficient to absorb part of the shock as the impactor downwardly strikes the stop member but does not absorb all of the shock so that sufficient impact remains to drive the shaft lower portion into the earth.

Figure 4:
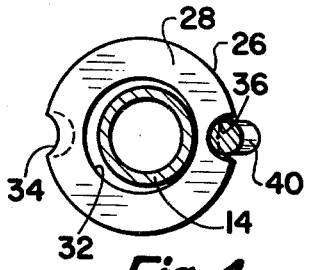
FIGS. 4 and 5 are cross-sectional views taken along the lines 4—4 and 5—5 respectively of FIG. 2.
Figure 5:
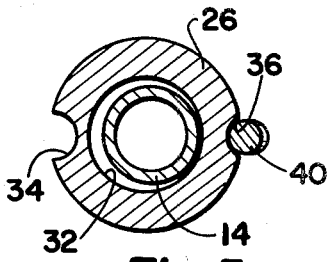

As previously indicated, one problem with devices of the type illustrated and described is that of keeping the components together so that they do not become lost from each other or that they do not slide around relative to each other. Particularly, the impactor 26 has a tendency to be reciprocally moved when it is left on the shaft if the earth anchor is transported in a vehicle or during shipment. The invention provides a unique way of locking the impactor to the shaft upper portion so that the entire device is secured and all parts are held together with none moveable relative to the other. This is achieved by the use of the inclined elongated slots 34 and 36 in conjunction with handle 38. When shown in FIGS. 2, 3, and 4, the handle 38 can be placed so that the short portion 42 is within one of the openings 24, the uppermost opening being employed in the illustration of FIG. 2. With the handle in this position, the long portion 40 can be placed in groove 36 and the impactor 26 moved towards the short portion 42. Because of the taper of groove 36, the long portion 40 is wedged outwardly. This wedges the short portion 42 of the handle in the opening 24 and at the same time wedges the handle against the impactor 26 and the impactor against the shaft 14. In the position as shown in FIG. 2, the shaft, impactor, and handle are all secured together so that none of the parts can be lost from the others and no part tends to move around when the device is being transported. To release the impactor 26, it is only necessary to jar the lower end 18 of the shaft against a hard object.

Since the impactor may be placed in the inverse position, that is, with the end 28 on the bottom and end 30 on the top, the grooves 34 and 36 are inclined in opposite directions so that regardless of the orientation of the impactor on shaft 14, it can be securely positioned against the handle 38 as shown without the necessity of turning it around.

The invention described fulfills the objectives initially set forth. A unique device is provided for use by home owners, campers, picnickers, sportsmen, and the like. It has many useful applications and innovative features which are not known in the other types of comparable devices.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. An earth anchor comprising:

an elongated shaft having a pointed lower end and having at least one opening therethrough perpendicular to the shaft longitudinal axis and in the upper portion thereof;

an enlarged external diameter stop member affixed to said shaft intermediate the ends thereof and below said openings;

a weighted impactor having an internal opening therethrough of a diameter greater than the external diameter of said shaft portion above said stop member, the impactor being slidably received on said shaft upper portion, the impactor having at least one external surface area in a plane of the axis of said opening therethrough which is tapered; and an elongated handle member having at least one end portion of an external diameter less than said shaft opening, the shaft being driven in the earth by the reciprocal downward impact of said impactor on said stop member and the shaft can be extricated from the earth by reciprocal impact of said impactor against said handle member positioned in said opening in said shaft, and wherein said handle member is of L-shaped configuration whereby a first portion of said handle member may be inserted into said opening in said shaft with the second portion extending generally parallel to and spaced apart from said shaft and whereby said impactor tapered surface may be forced against said handle second portion by longitudinally positioning said impactor on said shaft to restrain said impactor against further longitudinal movement.

2. An earth anchor according to claim 1 wherein the lower end of said shaft is configured in a chisel point defined by intersecting opposed planar surfaces whereby said handle received in one of said openings in said shaft may be employed to rotate said shaft as said impactor is employed to drive the shaft into the earth.

3. An earth anchor according to claim 1 wherein at least the upper portion of said shaft is tubular whereby elongated objects may be received and supported within the tubular opening when the lower shaft portion is driven into the earth.

4. An earth anchor according to claim 1 wherein said impactor is of elongated cylindrical configuration and wherein said tapered surface is in the form of a groove in the exterior surface, the groove being in a plane of the longitudinal opening axis.

5. An earth anchor according to claim 1 wherein said impactor is of elongated cylindrical configuration having a first and a second spaced apart groove in the exterior surface, each of said grooves being tapered relative to the axis of said impactor longitudinal opening, the taper in one groove being opposite to the taper of the other groove.

* * * * *